United States Patent [19]

Dalmau Güell

[11] Patent Number: 4,640,104

[45] Date of Patent: Feb. 3, 1987

[54] NEEDLE SELECTION ARRANGEMENT FOR A CIRCULAR KNITTING MACHINE

[75] Inventor: José M. Dalmau Güell, Barcelona, Spain

[73] Assignee: Jumberca, S.A., Badalona, Spain

[21] Appl. No.: 825,672

[22] Filed: Jan. 23, 1986

Related U.S. Application Data

[63] Continuation of Ser. No. 657,967, Oct. 5, 1984, abandoned.

[30] Foreign Application Priority Data

Oct. 10, 1983 [ES] Spain ..... 526.696

[51] Int. Cl.[4] ..... D04B 15/68; D04B 15/82

[52] U.S. Cl. ..... 66/222

[58] Field of Search ..... 66/25, 75.1, 75.2, 222, 66/223, 224, 226, 227

[56] References Cited

U.S. PATENT DOCUMENTS

| | | | |
|---|---|---|---|
| 1,531,272 | 3/1925 | Burson | 66/75.1 X |
| 3,930,383 | 1/1976 | Nuber | 66/25 |
| 3,955,380 | 5/1976 | Piccino et al. | 66/222 X |
| 4,541,254 | 9/1985 | Schindele et al. | 66/223 |

FOREIGN PATENT DOCUMENTS

| | | | |
|---|---|---|---|
| 2252431 | 6/1975 | France | 66/219 |
| 2061327 | 5/1981 | United Kingdom | 66/75.2 |
| 494467 | 3/1976 | U.S.S.R. | 66/224 |

*Primary Examiner*—Wm. Carter Reynolds
*Attorney, Agent, or Firm*—Staas & Halsey

[57] ABSTRACT

A needle selector arrangement in a circular knitting machine, which in each of the working sections or sets allows the needles to be selected simultaneously to knit, tuck or welt. It is provided with cam sets in association with intermediate jacks having a long upper butt and a short lower butt and said intermediate jacks are adapted to assume three different positions, one in which both butts emerge, corresponding to the jersey knitting stage, another in which only part of the long butt emerges corresponding to the tucking stage and a third position in which no butt emerges, corresponding to the welting stage.

5 Claims, 5 Drawing Figures

NEEDLE SELECTION ARRANGEMENT FOR A CIRCULAR KNITTING MACHINE

This is a continuation of co-pending application Ser. No. 657,967 filed on Oct. 5, 1984, now abandoned.

BACKGROUND OF THE INVENTION

The invention relates to a needle selection arrangement for a circular knitting machine, the arrangement comprising a selector cam box, selector jacks, intermediate jacks, single butt needles and cam sets for the intermediate jacks and needles.

The object of the invention is to provide a selection arrangement providing in each of the working sections or sets the possibility of simultaneously selecting needles in knit positions, tuck positions or welting positions.

SUMMARY OF THE INVENTION

For the above object, the arrangement of the invention is characterised in that the said intermediate jacks are provided with two butts of different length, a long upper butt for tucking and a short lower butt for jersey knitting, said intermediate jacks being in engagement with the selector jacks. These latter selectively adopt three different angles of tilt, and transmit these angles to the intermediate jacks to determine a like number of positions of the butts thereof, both butts emergent corresponding to the knit position; part of the long butt emergent corresponding to the tuck position and no emergent butt corresponding to the welting position. There are three channels in each set of cams, the upper one of which is for the needle butt, the intermediate one for the long butt and the bottom one for the short butt of the intermediate jack, the intermediate channel being spaced from the lower channel in a distance shorter than the distance between the two butts.

BRIEF DESCRIPTION OF THE DRAWINGS

Further objects and features of the invention will be disclosed in detail in the following description to be read in conjunction with the accompany illustrative drawings in which.

DETAILED DESCRIPTION OF THE PREFERRED EMBODIMENT

Figure 1:
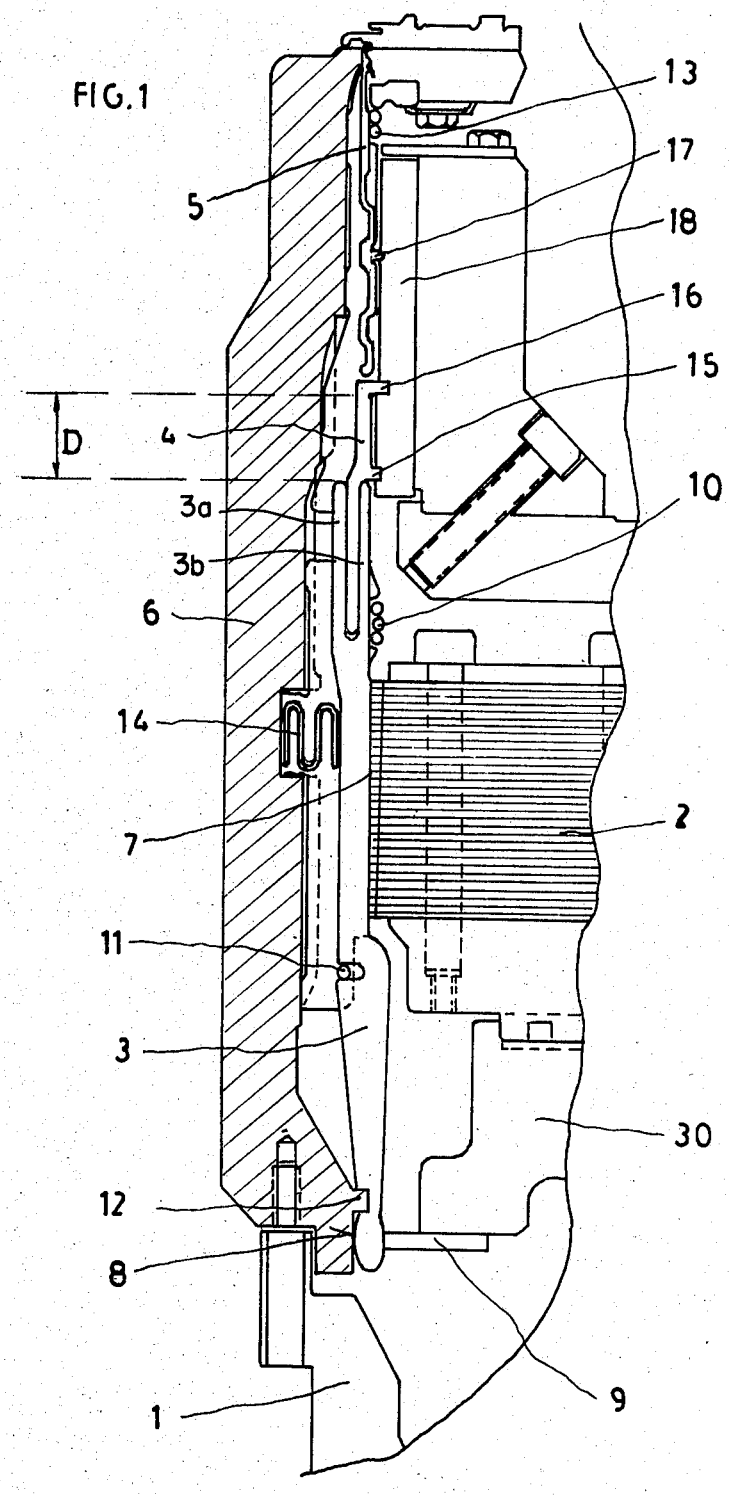
FIG. 1 is a vertical cross section of the cylinder of a circular knitting machine, showing the inventive arrangement of the selection system thereof.

In FIG. 1 there is shown the moving ring 1 and, on the fixed body holder 30 of a circular knitting machine, a selector box 2 associated with the corresponding selector jacks 3, the intermediate jacks 4 and the needles 5, disposed in a needle cylinder 6.

In the known way, selector cams 7 of the selector box 2 act upon the selector jacks 3 mounted in the cylinder 6 and which rock against the cylinder about a convex curved point 8. At the height of this point, the opposite side is supported by an adjustable pusher 9. Furthermore, the selector jacks 3 are retained by springs 10, are positioned heightwise by springs 11 and are spaced apart by ribs 12. The selector jacks 4 are positioned between upper extensions 3*a* and 3*b* of selector jacks 3. Thus, the intermediate jacks 4 follow the rocking or tilting motion of the intermediate jacks 3. However, the intermediate jacks 4 may move logitudinally relative to the selector jacks 3.

In turn, the needles 5 are retained by further springs 13 and additional springs 14 individually urge the selector jacks 3 against the springs 10 of the box 2.

According to the invention, the intermediate jacks 4 are provided with a short lower butt 15 and a long upper butt 16, while the needles are provided with a single butt 17. The short butt 15 is used for jersey knitting and the long butt 16 is used for tucking.

Figure 2:
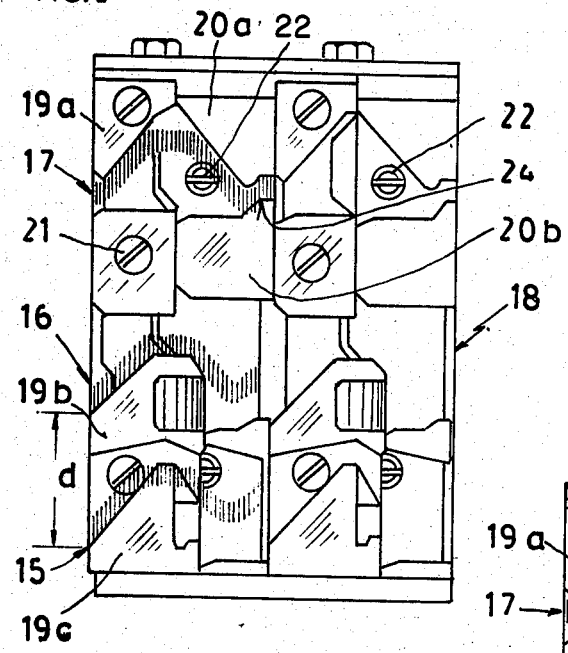
FIGS. 2 to 4 inclusive illustrate on a larger scale the different paths followed by the needles and intermediate jacks through the cam channels for the tuck, knit and welting positions, respectively, said paths being illustrated with series of short vertical strokes.
Figure 3:
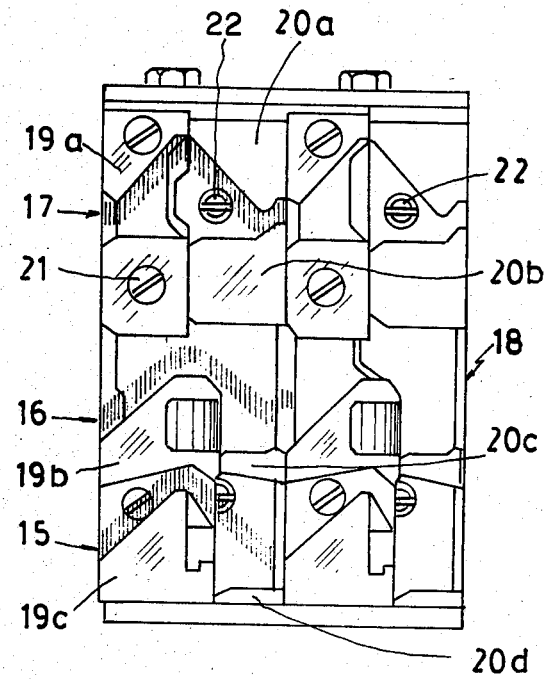
Figure 4:
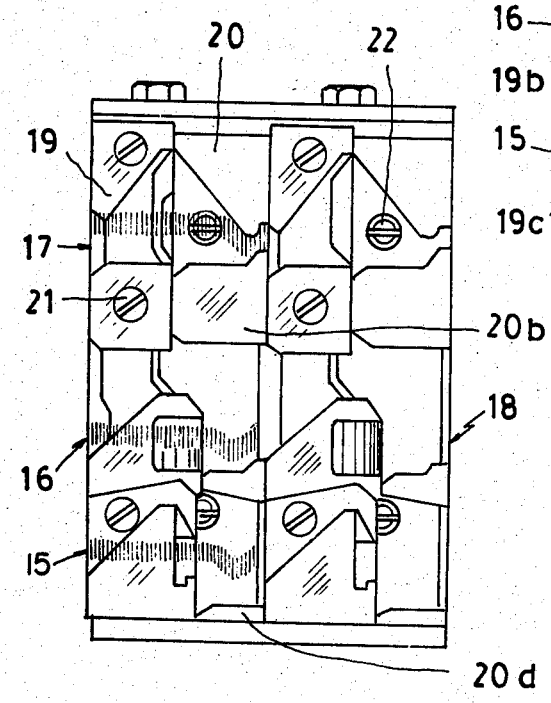

The said butts 15, 16 and 17 follow their own paths defined by the cams 19*a*, 19*b* and 19*c* and 20*a*, 20*b*, and 20*c* of the body 18, a situation shown schematically in FIGS. 2, 3 and 4, in such a way that the movements of such butts are attained from three possible positions provided by the cams 7 of the box 2, duly set for each machine working programme. From the vertical position in the jersey knitting stage, the intermediate jacks 4 gradually tilt to the tuck and welting positions, producing the corresponding paths.

The cam body 18 comprises a support holding a number of blocks, in the known form, in which there are housed sets of cams 19*a*, 19*b* and 19*c*, on the one hand, and further cams 20*a*, 20*b*, 20*c* and 20*d* on the other hand, forming respective columns, with the corresponding holding screws 21 and nuts 22 which, with the corresponding grooves define the channels for the butts 15, 16 and 17.

As far as the grooves for the butts 15 and 16 of the intermediate jacks 4 are concerned, the distance D between the lower edges of said butts is greater than the distance d between the respective grooves.

In this way, FIG. 3 illustrates the knitting operation, comprising the participation of both butts 15 and 16 of an intermediate jack 4, plus the butt 17 of a needle 5, butt 15 being the operative one, wherein the selector jack 3 has been urged to the knit position by spring 14, i.e. is in the vertical position as shown in FIG. 1, and butts 15 engage cams 19*c*. In view of this, said butt 15 runs up the cam 19*c* to the peak and then down the other side, whereby butt 16 follows a similar path but spaced apart from cam 19*b*, while butt 17 of the needle 5 follows the same upward path pushed by the intermediate jack 4 to the maximum rise position. During this part of the movement, the cam 19*a* acts as a countercam, engaging the butt 17 and limiting the upward movement of the needle 5, thereby preventing the needle from experiencing excessive upward movement. The drawdown movement of the needle-intermediate jack unit is controlled by the cam 20*a* which engages the butt of the needle and the needle acts on the jack. In this part of the movement, the cams 20*b*, 20*c* and 20*d* act as countercams to prevent the needle of jack from descending too far.

FIG. 2 illustrates the tucking movements, with the participation of the butt 16 of the intermediate jack 4 and butt 17 of the needle 5, butt 16 being the operative one, wherein the selector jack 3 is tilted away from vertical position so that the short lower butt 15 does not engage cam 19*c*. However, part of the long upper butt does engage cam 19*b*. In this case, said butt 16 follows its channel marked by cam 19b up which it rises, causing the butt 17 of the needle 5 to follow a like movement to that of the butt 16, without it engaging cam 19a, until it engages cam 20a, from which time this cam marks the drawdown path combined with the cam 20b to maintain contact with the first cam 20a. In this case, the butt 15 of the jack 4 passes in front of the cams without making contact therewith.

FIG. 4 illustrates the welting position. The selector jack 3 is in the tilted position most removed from vertical so that neither upper butt 16 nor lower butt 15 engage cams 19b and 19c. Thus, the butts of the intermediate jack 4 are not operative, causing the needle butt 17 to move unaffected by the cams along a straight line and the needle to welt, at the same time that the butts 15 and 16 of the said jack 4 pass in front of the faces of the cams without making contact with the cams.

Figure 5:
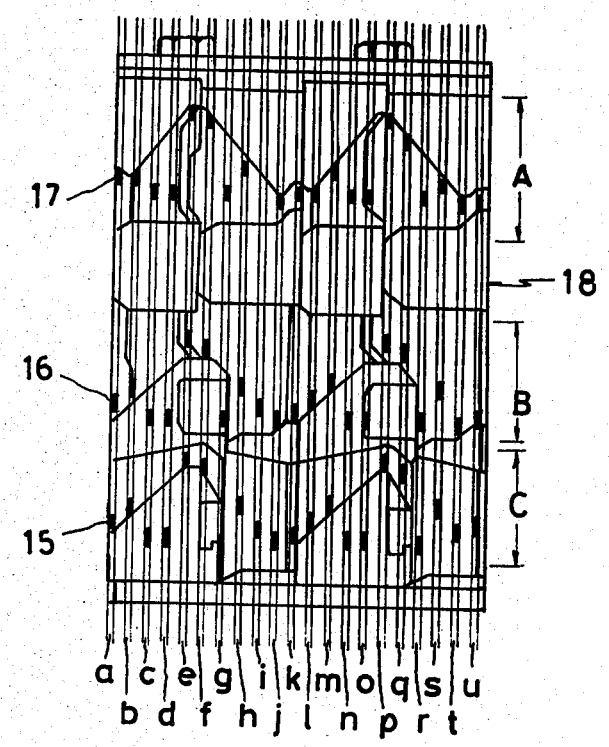
FIG. 5 illustrates the momentaneous position at a particular time of both butts of the intermediate jacks and the needle butts superimposed on the cam channels of a cam body.

FIG. 5 shows, as stated hereinbefore, the momentaneous position of the short lower butt 15 and of the long upper butt 16 of the intermediate jacks and of the butt 17 of the needle 5, shown superimposed on the cam body 18. The butts 17 are comprised in section A, the butts 16 in section B and the butts 15 in section C and are respectively in each of the lines a–u which represent the jack-needle units that are over the said cam body 18 at the time considered. As may be seen, lines c, d, g, n, o and r correspond to welting needles; line f corresponds to a tucking needle; lines e, p and q, correspond to the knitting position (e.g. jersey knitting); lines j, k, t and u correspond to jack-needle units in the selection area; lines h, i and s correspond to jack-needle units in the drawdown stage after knitting or tucking and lines a, b, l and m correspond to jack-needle units rising along the common channel for knitting or tucking.

In view of the above, the three types of needle 5 operation are achieved with the new arrangement of selection described with the use of a single intermediate jack for each needle.

What I claim is:

1. A needle selection apparatus for a circular knitting machine, comprising:

a selector box including selector cams; selector jacks, each selector jack having two upper extensions; intermediate jacks corresponding to respective ones of the selector jacks and positioned between the upper extensions of the corresponding selector jack; needles each having a butt; and cam sets for the intermediate jacks and the needles, wherein the intermediate jacks are provided with a long upper butt for tucking and a short lower butt for jersey knitting, said intermediate jacks being in engagement with respective ones of the selector jacks which selectively adopt three different angles of tilt, so that said intermediate jacks correspondingly adopt three angles of tilt, thereby determining three positions of the upper and lower butts so that the upper and lower butts are emergent corresponding to the knit position, so that part of the upper butt is emergent corresponding to the tuck position, and so that there is no emergent butt corresponding to the welting position, each set of cams having an upper channel for engaging the butt of the needle, an intermediate channel for engaging the upper butt, and a lower channel for engaging the short butt of the intermediate jack, the intermediate channel being spaced from the lower channel by a distance (d) smaller than a distance (D) between lower edges of the upper and lower butts.

2. The apparatus of claim 1, further comprising springs for urging the selector jacks to the knit position.

3. The apparatus of claim 1, wherein the selector jacks each have a lower end provided with a convex curved area bearing against a needle cylinder with a clearance controlled by an adjustable pusher.

4. A needle selection apparatus in a circular knitting machine including a plurality of needles each having a butt, comprising:

a plurality of selector jacks, each selector jack having two upper extensions;

means for tilting each selector jack to first, second and third positions;

means for urging each selector jack to the first position;

a plurality of intermediate jacks corresponding to respective ones of the selector jacks, each intermediate jack being positioned between said upper extensions of and in tilting engagement with the corresponding selector jack, and being in abutting contact with the needles, each intermediate jack having an upper and lower butts each having a lower edge, the lower butt being shorter than the upper butt and the lower edges of the upper and lower butts being spaced apart by a first distance; and cam sets, each having an upper channel for engaging the butts of the needles, an intermediate channel for engaging the upper butt when the selector jack is in the second position, and a lower channel for engaging the lower butt when the selector jack is in the first position, the upper and lower butts being disengaged from the intermediate and lower channels when the selector jack is in the third position, and the intermediate and lower channels being spaced apart by a second distance which is smaller than the first distance.

5. An apparatus according to claim 4, wherein the first position is for jersey knitting, wherein the second position is for tucking, and wherein the third position is for welting.

* * * * *